US005784987A

United States Patent [19]

Mizuno

[11] Patent Number: 5,784,987

[45] Date of Patent: Jul. 28, 1998

[54] EMBROIDERY DATA PROCESSING UNIT

[75] Inventor: Masahiro Mizuno, Nagoya, Japan

[73] Assignee: Brother Kogyo Kabushiki Kaisha, Nagoya, Japan

[21] Appl. No.: 863,185

[22] Filed: May 27, 1997

[30] Foreign Application Priority Data

May 27, 1996 [JP] Japan ..... 8-131758
Jan. 27, 1997 [JP] Japan ..... 9-012313

[51] Int. Cl.[6] ..... D05B 21/00; D05C 5/04

[52] U.S. Cl. ..... 112/102.5; 112/445

[58] Field of Search ..... 112/102.5, 445, 112/454, 456, 458, 470.06, 457, 470.04

[56] References Cited

U.S. PATENT DOCUMENTS 4,499,836 2/1985 Meier et al. ..... 112/454 X
4,860,678 8/1989 Skogward ..... 112/445 X
4,960,061 10/1990 Tajima et al. ..... 112/445 X
5,560,306 10/1996 Kyuno et al. ..... 112/102.5

FOREIGN PATENT DOCUMENTS 4-126186 4/1992 Japan .
8-52290 2/1996 Japan .

*Primary Examiner*—Peter Nerbun
*Attorney, Agent, or Firm*—Oliff & Berridge PLC

[57] ABSTRACT

An embroidery data processing unit includes RAM memory to store the sewing order for multiple sewing areas, and to store two or more sewing areas from among the multiple sewing areas in order to verify their order. The processing unit determines the sewing order for the areas extracted from the multiple sewing areas, and the sewing area is displayed on a CRT monitor. This configuration allows the user to verify the sewing order of specific sewing areas in a short period of time.

22 Claims, 9 Drawing Sheets

EMBROIDERY DATA PROCESSING UNIT

BACKGROUND OF THE INVENTION

The present invention relates to an embroidery data processing unit capable of targeting several sewing areas among a plurality of sewing areas and verifying the sewing order of the targeted several sewing areas.

Japanese Patent Application Kokai (OPI) No. HEI-4-126186 discloses an embroidery data processing unit capable of verifying the sewing order established for a plurality of sewing areas. This data processing unit allows the sewing order for all of the arranged sewing areas to be verified by displaying the sewing areas in order from the first sewing area to the last sewing area.

However, since all of the arranged sewing areas are displayed with this conventional data processing unit, not only areas In which the sewing order must be verified, but also areas in which the sewing order need not be verified, are displayed. Hence, more time than necessary is spent to verify the sewing orders of the desired areas.

The same problem as above is also acknowledged in an embroidery machine disclosed in Japanese Patent Application Kokai (OPI) No. HEI 8-52290. According to the disclosed embroidery machine, a plurality of embroidery patterns are provisionally stored in a ROM card as embroidery pattern data, and if an operator selects one of the embroidery patterns, every part forming the selected embroidery pattern is displayed in order from the first sewing part to the last sewing part.

Therefore, similar to the embroidery machine of JP HEI-4-126186, unwanted parts which do not need to be verified are also displayed. Further, only the embroidery patterns provisionally stored in the ROM card are available for the purpose of verifying the sewing order. In other words, a new embroidery pattern designed by the operator is not available for verifying the sewing order from the first sewing part to the last sewing part. Moreover it would be impossible to verify the sewing order among "selected parts" of the selected embroidery pattern stored in the ROM card nor among "selected parts" of the newly designed embroidery pattern.

In another aspect, according to the JP HEI 8-52290 publication, only the selected embroidery pattern is subjected to the verification of the sewing order from the first part to the last part, the combination of parts forming the selected embroidery pattern. However, in embroidery sewing, another demand has been made to allow the sewing of a plurality of embroidery patterns onto a fabric. In such a case, the operator wants to know the sewing order among selected embroidery patterns. In this connection, the sewing machine disclosed in the JP HEI 8-52290 publication only shows the sewing order for all "parts" of the selected one embroidery pattern, and does not meet this demand.

SUMMARY OF THE INVENTION

In view of the foregoing, it is an object of the present invention to provide an embroidery data processing unit capable of verifying the sewing order of only the necessary areas or parts.

Another object of the present invention is to provide such an embroidery data processing unit capable of verifying the sewing order of only the necessary areas of a newly designed embroidery pattern newly produced by an operator.

Still another object of the present invention is to provide such an embroidery data processing unit capable of verifying the sewing order of necessary areas, the areas being selected parts consisting of one embroidery pattern, or being selected embroidery patterns among various embroidery patterns.

These and other objects of the present invention will be attained by providing an embroidery data processing unit comprising means for creating a sewing pattern having a plurality of sewing areas, memory means for storing a sewing order with respect to the plurality of sewing areas, extracting means for extracting at least two sewing areas from among the plurality of sewing areas as targets for verification of sewing order, distinguishing means for distinguishing the sewing order of the at least two sewing areas extracted by the extracting means, and display means for displaying the sewing areas according to a distinguishing result by the distinguishing means and for displaying the sewing pattern created by the creating means.

In another aspect of the invention, there is provided an embroidery data processing unit for acknowledging sewing order with respect to a plurality of sewing areas, a combination of the plurality of sewing areas providing one kind of a sewing pattern, the unit comprising memory means for storing a sewing order with respect to the plurality of sewing areas, extracting means for extracting at least two sewing areas from among the plurality of sewing areas as targets for verification of sewing order, distinguishing means for distinguishing the sewing order of the at least two sewing areas extracted by the extracting means, and display means for displaying the sewing areas according to a distinguishing result in the distinguishing means.

In still another aspect of the invention, there is provided an embroidery data processing unit for acknowledging sewing order with respect to a plurality of sewing areas, the plurality of sewing areas being different kinds of sewing patterns independent of one another, the unit comprising memory means for storing a sewing order with respect to the plurality of sewing areas, extracting means for extracting at least two sewing areas from among the plurality of sewing areas as targets for verification of sewing order, distinguishing means for distinguishing the sewing order of the at least two sewing areas extracted by the extracting means, and display means for displaying the sewing areas according to a distinguishing result by the distinguishing means.

In still another aspect of the invention, there is provided an embroidery data processing unit for acknowledging sewing order with respect to a plurality of sewing areas having N number, the unit comprising memory means for storing a sewing order with respect to the plurality of sewing areas, extracting means for extracting from two sewing areas to (N−1) number of sewing areas from among the plurality of sewing areas as targets for verification of sewing order; distinguishing means for distinguishing the sewing order of the sewing areas extracted by the extracting means, and display means for displaying the sewing areas according to a distinguishing result by the distinguishing means.

BRIEF DESCRIPTION OF THE DRAWINGS

In the drawings:

FIG. 3(*b*) shows an example of a dialog box displayed on the display unit for verification of sewing order for the purpose of an interface allowing user input;

FIG. 9(*b*) shows a display which highlights a second sewing area among the selected sewing areas;

FIG. 10(*b*) shows a display which highlights a last sewing area among the selected sewing areas.

DETAILED DESCRIPTION OF THE PREFERRED EMBODIMENT

An embroidery data processing unit according to one embodiment of the present invention will be described with reference to the accompanying drawings.

Figure 1:
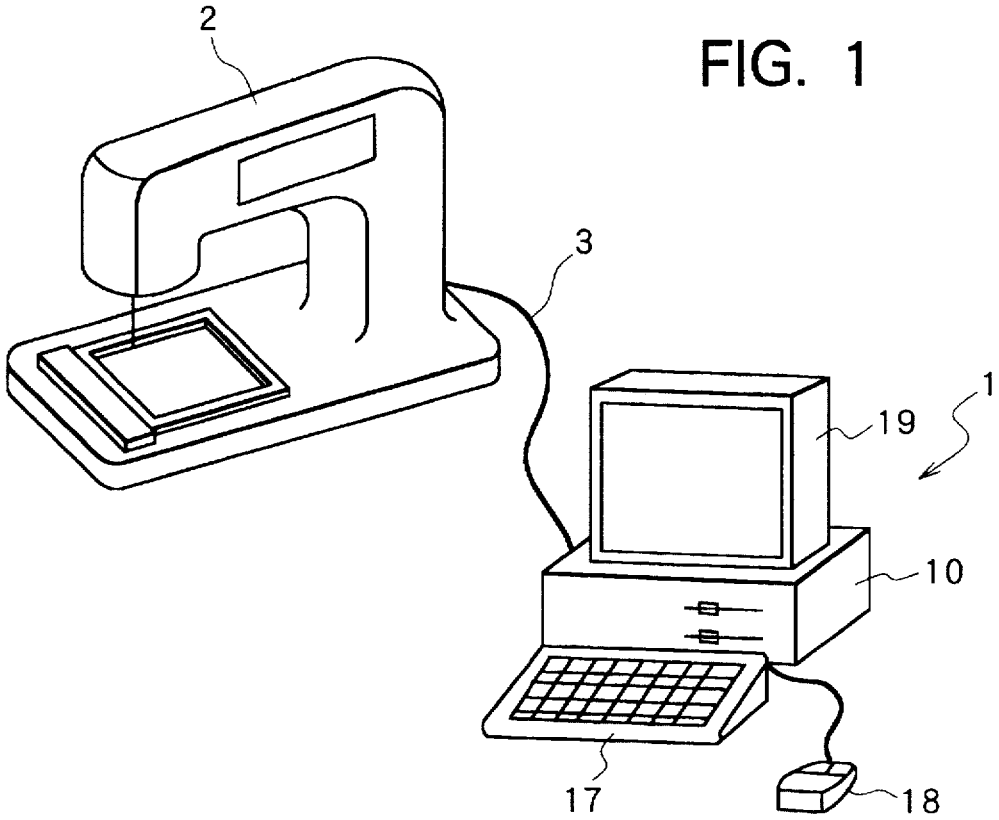
FIG. 1 is a schematic view showing a connection between an embroidery sewing machine and an embroidery data processing unit according to one embodiment of the present invention.

An electrical connection between an embroidery data processing unit 1 and an embroidery sewing machine 2 is shown in FIG. 1. The embroidery sewing machine 2 contains a control unit (not shown) provided with a microcomputer and various peripheral circuits necessary for operations thereof. Displacement of a workplace fabric and a movement of a sewing needle are controlled based on embroidery data provided to the control unit in order to stitch a desired embroidery pattern in the workplace fabric. The embroidery data includes such information as the position of the sewing needle with respect to the workplace fabric at every needle location and the color and type of embroidery thread to be used.

A communication line 3 is connected between the sewing machine 2 and the embroidery data processing unit 1. The embroidery data processing unit 1 is adapted for creating embroidery data based on sewing shapes provided by the user, to be described later, and for transferring that data to the embroidery sewing machine 2 via the communication line 3. In addition to the data provided from the embroidery data processing unit 1, data for a plurality of predetermined embroidery patterns are provisionally stored in the data processing unit or in a ROM card inserted into the sewing machine 2.

Figure 2:
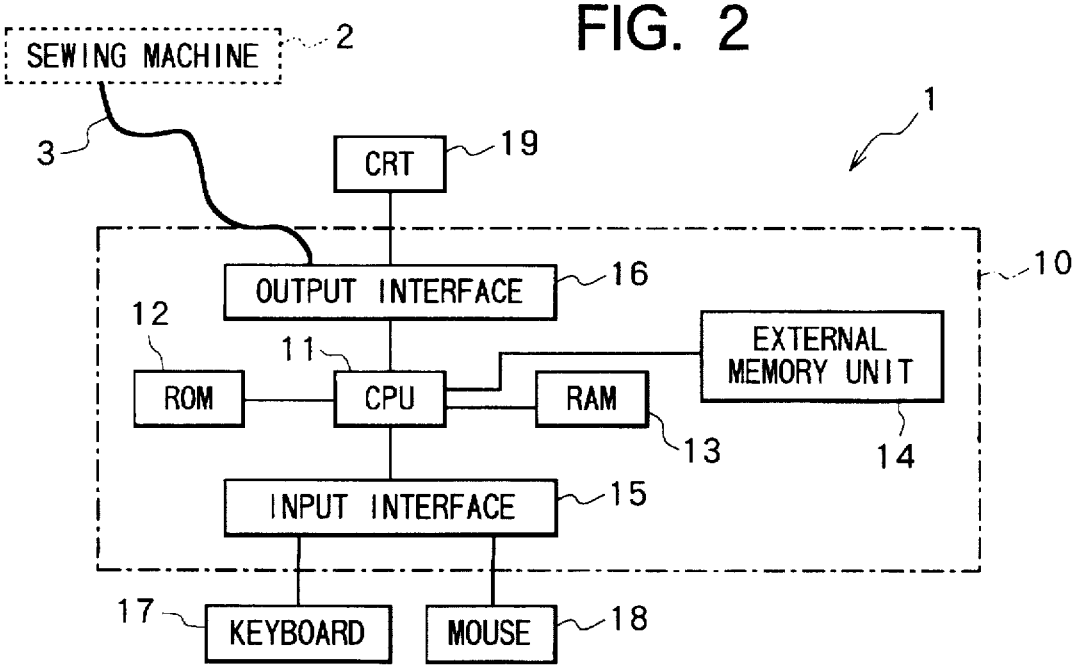
FIG. 2 is a block diagram showing the data processing unit of FIG. 1.

The embroidery data processing unit 1 includes a main unit 10, a keyboard 17 and a mouse 18 or a pointing device as means for inputting data into the main unit 10, and a CRT monitor 19 as means for displaying data for the user. As shown in FIG. 2, the main unit 10 includes a CPU 11 configured with a microprocessor unit, a ROM 12, a RAM 13, an external memory unit 14 such as a magnetic disk memory unit, an input interface 15, and an output interface 16, which are all (12–16) connected to the CPU 11.

The ROM 12 stores programs and data needed by the CPU 11 to control basic operations of the embroidery data processing unit 1 typically after the embroidery data processing unit 1 is powered ON. The external memory unit 14 stores programs and data needed to create embroidery data. These programs and data are read into the RAM 13 as the need arises. The RAM 13 has a sewing order storage area A serving as memory means and a verification target storage area B described later. Further, a sewing order management counter (not shown) is provided for counting order of the selection of the areas. The verification target storage area B and the counter function as distinguishing means.

The keyboard 17 and mouse 18 are connected to the input interface 15, so that the user gives instructions to create embroidery pattern by operating the keyboard 17 and mouse 18. The communication line 3 and CRT monitor 19 are connected to the output interface 16. The configuration of the embroidery data processing unit 1 is the same as that of a personal computer. In other words, the embroidery data processing unit 1 of the present embodiment combines software for creating embroidery data with a general purpose personal computer.

Figure 6:
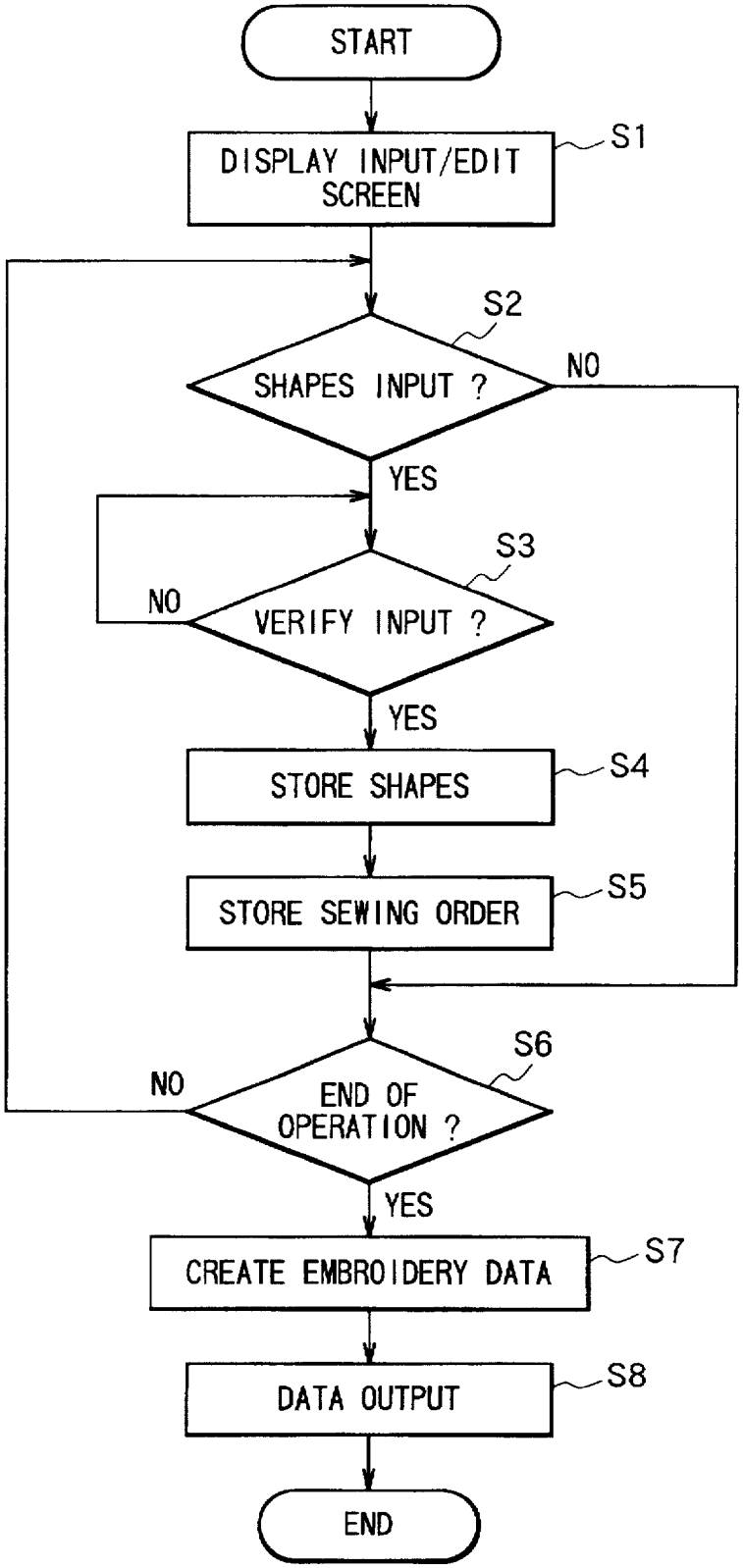
FIG. 6 is a flowchart showing an embroidery data creation process executed in the CPU of FIG. 2.

When the user gives instructions to create embroidery data by operating the keyboard 17 and the mouse 18, the CPU 11 executes the process shown in FIG. 6 for creating embroidery data.

Figure 3:
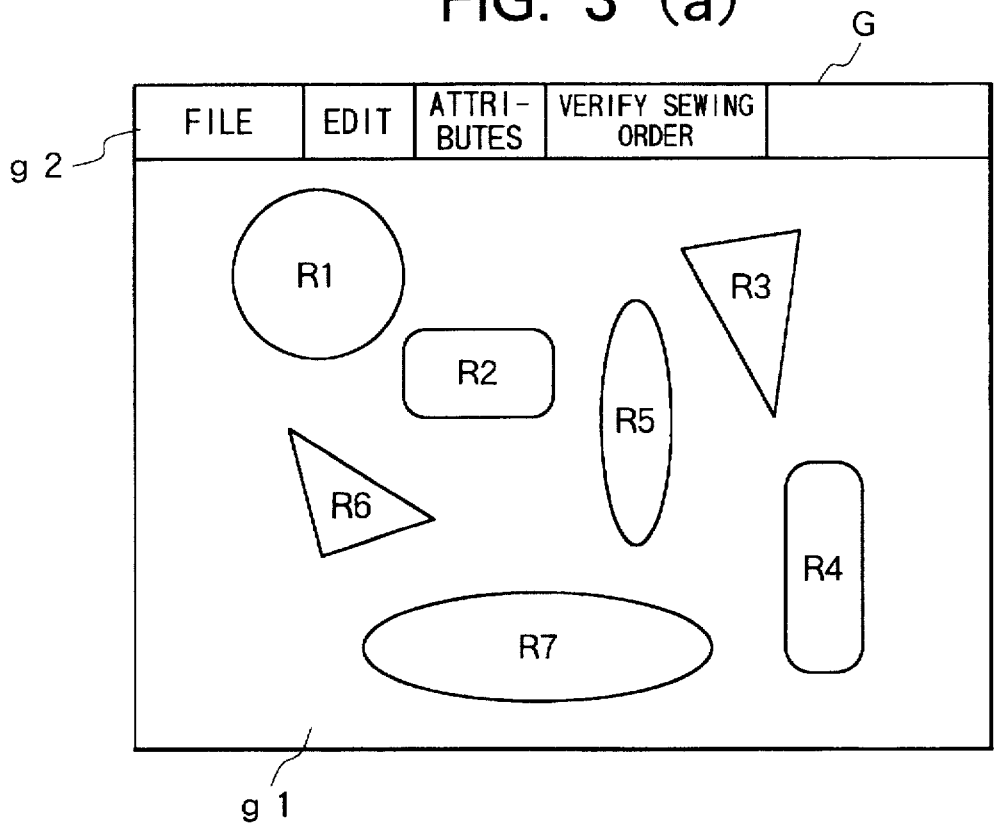
FIG. 3(*a*) shows an example display of sewing areas on a display unit of the embroidery data processing unit.
Figure 3:
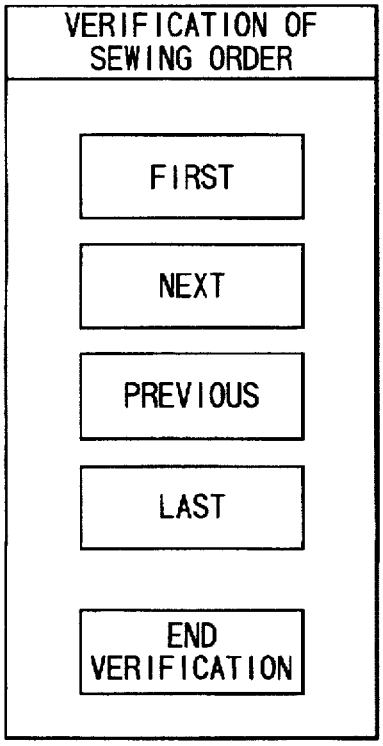

First, an input/edit screen G shown in FIG. 3(*a*) is displayed on the CRT monitor 19 (S1). The input/edit screen G includes an image area g1 and a function select area g2. In the image area g1, the outline of embroidery areas can be depicted using the mouse 18. For example, if the embroidery areas R1–R7 of FIG. 3(*a*) are desirable, the outlines of these embroidery areas can be sequentially drawn in the image area g1. In this case, each of the areas R1–R7 is a part of one specific embroidery pattern. That is, a combination of the areas creates one specific embroidery pattern. Alternatively, each of the areas R1–R7 is an embroidery pattern independent of each other.

Functions that can be selected when inputting and editing the shape of embroidery areas are displayed in the function select area g2. As shown in FIG. 3(*a*), the function select area g2 displays the functions "File", "Edit", "Attributes" and "Verify Sewing Order". Any of the functions displayed in the function select area g2 can be selected using the mouse 18, at which time the process of FIG. 6 is interrupted while the process corresponding to the function selected is executed. The process of FIG. 6 resumes after the process corresponding to the function selected is ended. Of the functions shown in FIG. 3(*a*), only the "Verify Sewing Order" function will be described. Descriptions of all other functions will be omitted.

After the input/edit screen G is displayed, the CPU 11 determines whether shapes for embroidery areas have been input (S2). If no shapes have been input (S2: No), the process jumps to S6. However, if shapes have been additively input (S2: Yes), the CPU 11 waits for verification of the input (S3). In the step S2, the shapes that were input are displayed in the image area g1.

Figure 5:
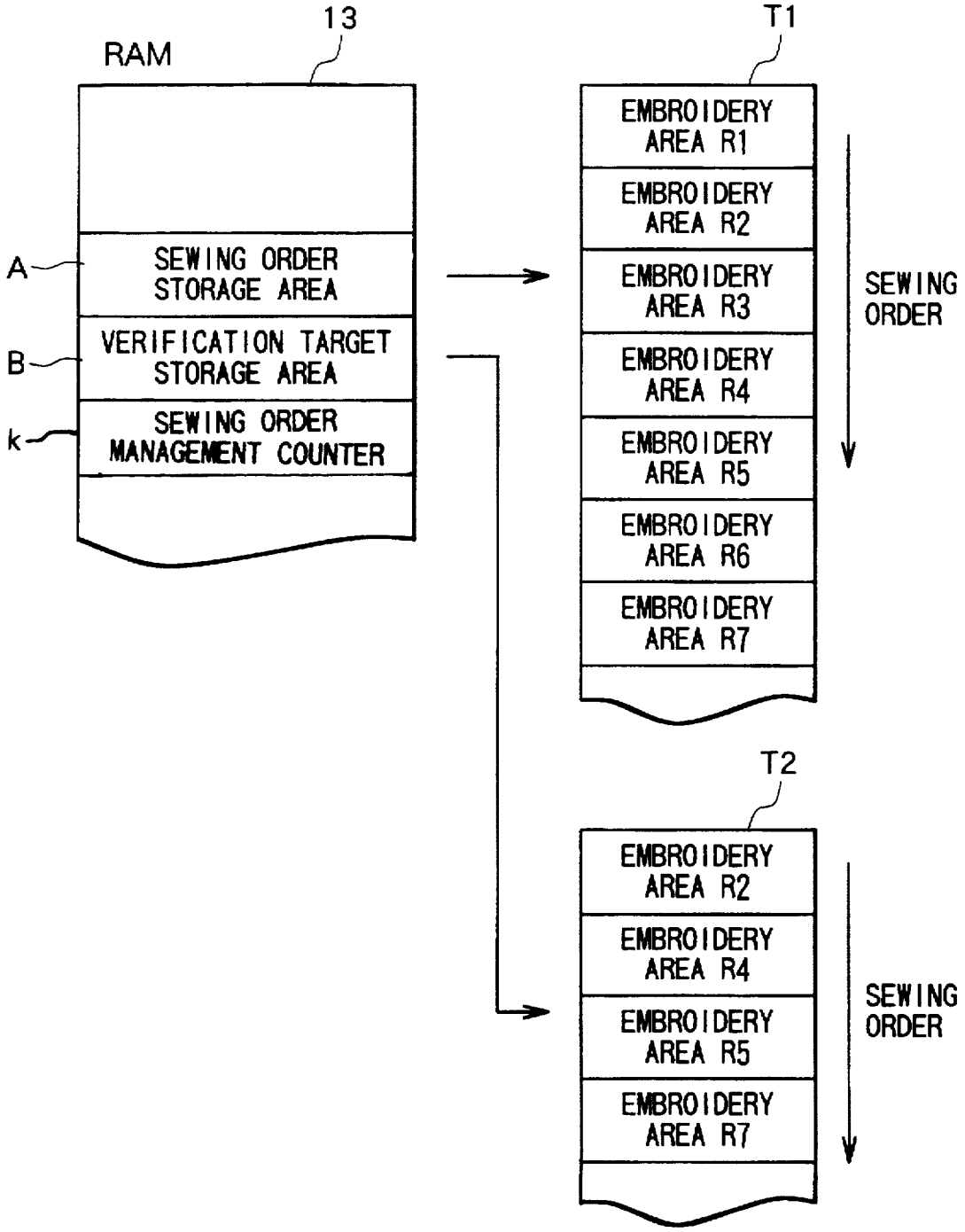
FIG. 5 shows a conceptual view of a sewing order memory area and a verification target memory area set in a RAM of FIG. 2, and examples of the sewing order memory tables constructed in these memory areas.

When the process of inputting shapes is complete (S3: Yes), the embroidery shapes displayed are stored in memory (S4), and the order that the shapes were input is stored in the RAM 13 as the sewing order (S5). FIG. 5 shows a conceptual representation of the manner in which the sewing order is stored in memory when the embroidery areas shown in FIG. 3(*a*) are input in the order of from R1 to R7. The sewing order storage area A is allocated at a prescribed area of the RAM 13, in which area a sewing order storage table T1 is constructed. The embroidery areas R1–R7 are written to this table T1 beginning from the top of the table according to the order that the areas were input. In this embodiment, it will be assumed that only the outlines of the embroidery areas R1–R7 are set as embroidery areas and that no sewing within the outlines is specified. If sewing is specified for both the outlines and the areas within the outlines, both can be treated as separate sewing areas even when they belong to the same embroidery area.

After the sewing order has been stored in the storage area A of the RAM 13 (S5), the CPU 11 determines whether the input operation was ended (S6). This determination can be based on whether or not the user performed an operation to end input. If the operation is not complete (S6: No), the process repeats from the step S2. If the operation is complete (S6: Yes), the embroidery data is created (S7) and output to the embroidery sewing machine 2 (S8). When the embroidery data is created, the sewing order for the embroidery areas is determined based on the data stored in the sewing order storage table T1.

Figure 4:
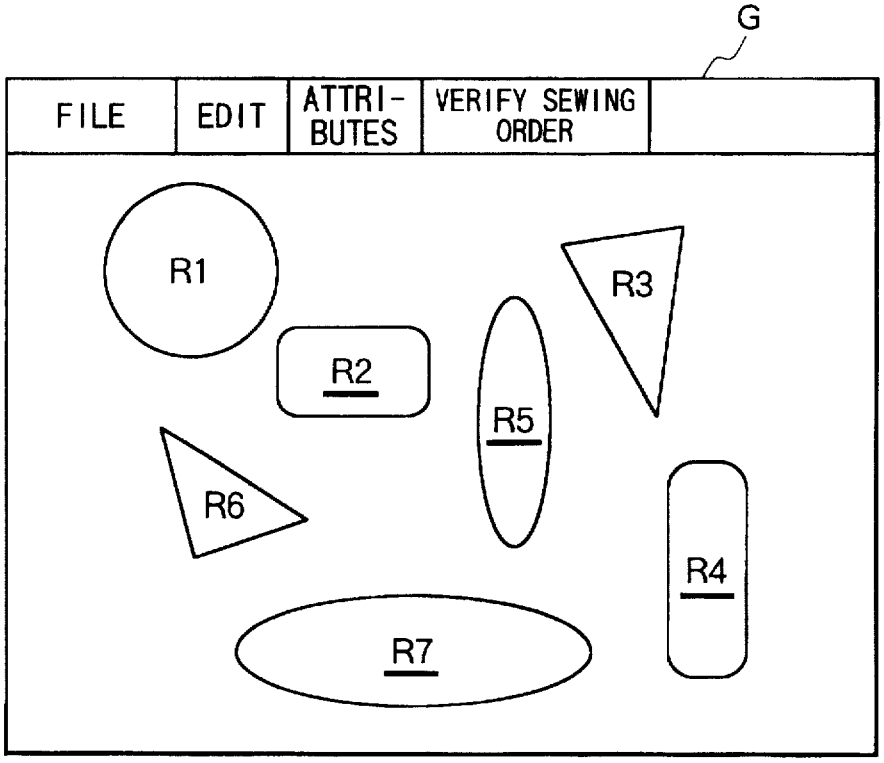
FIG. 4 shows the example display of sewing areas after certain areas have been selected.
Figure 7:
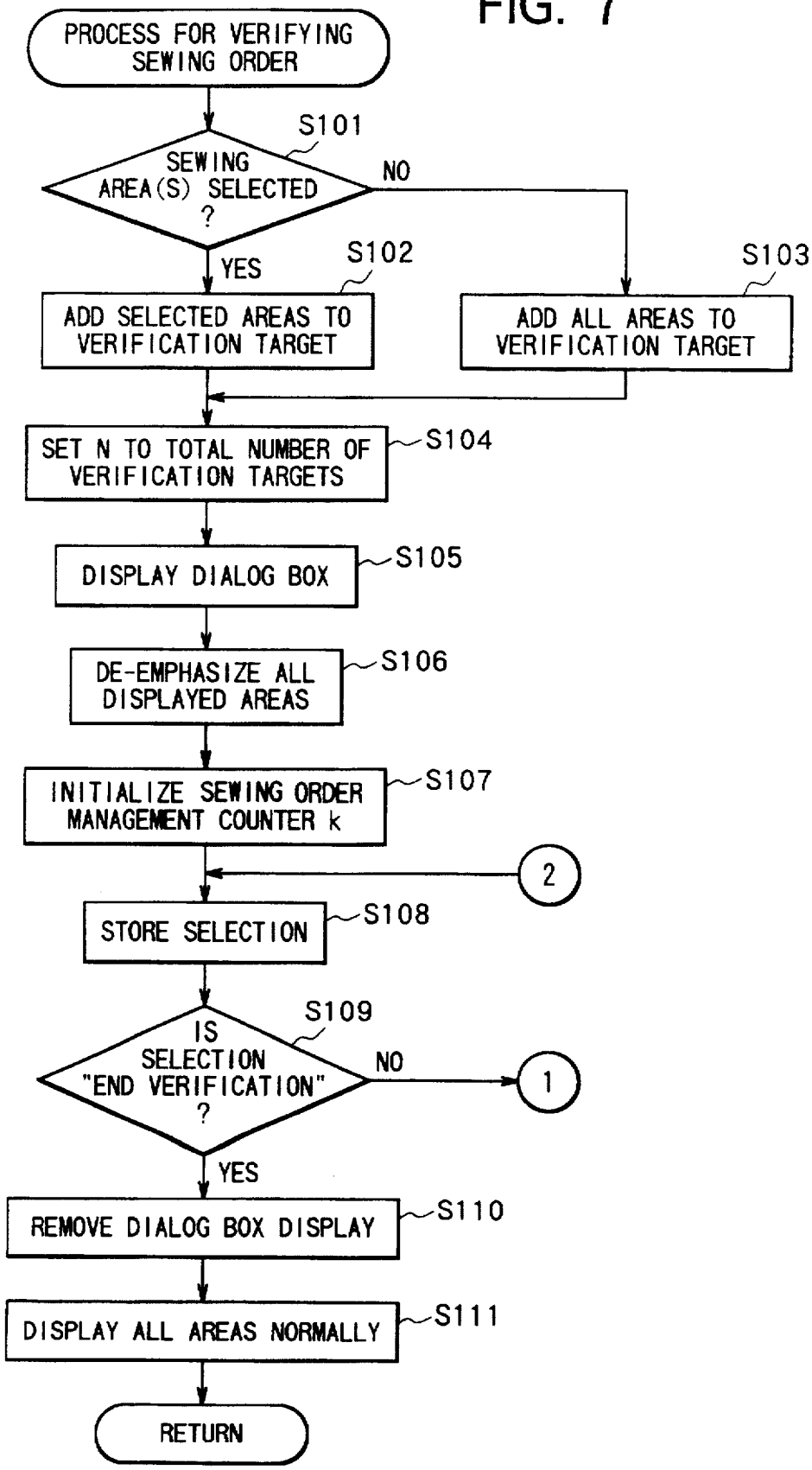
FIG. 7 is a flowchart showing a first part of a sewing order verification process executed as an interrupt in the process of FIG. 6.
Figure 8:
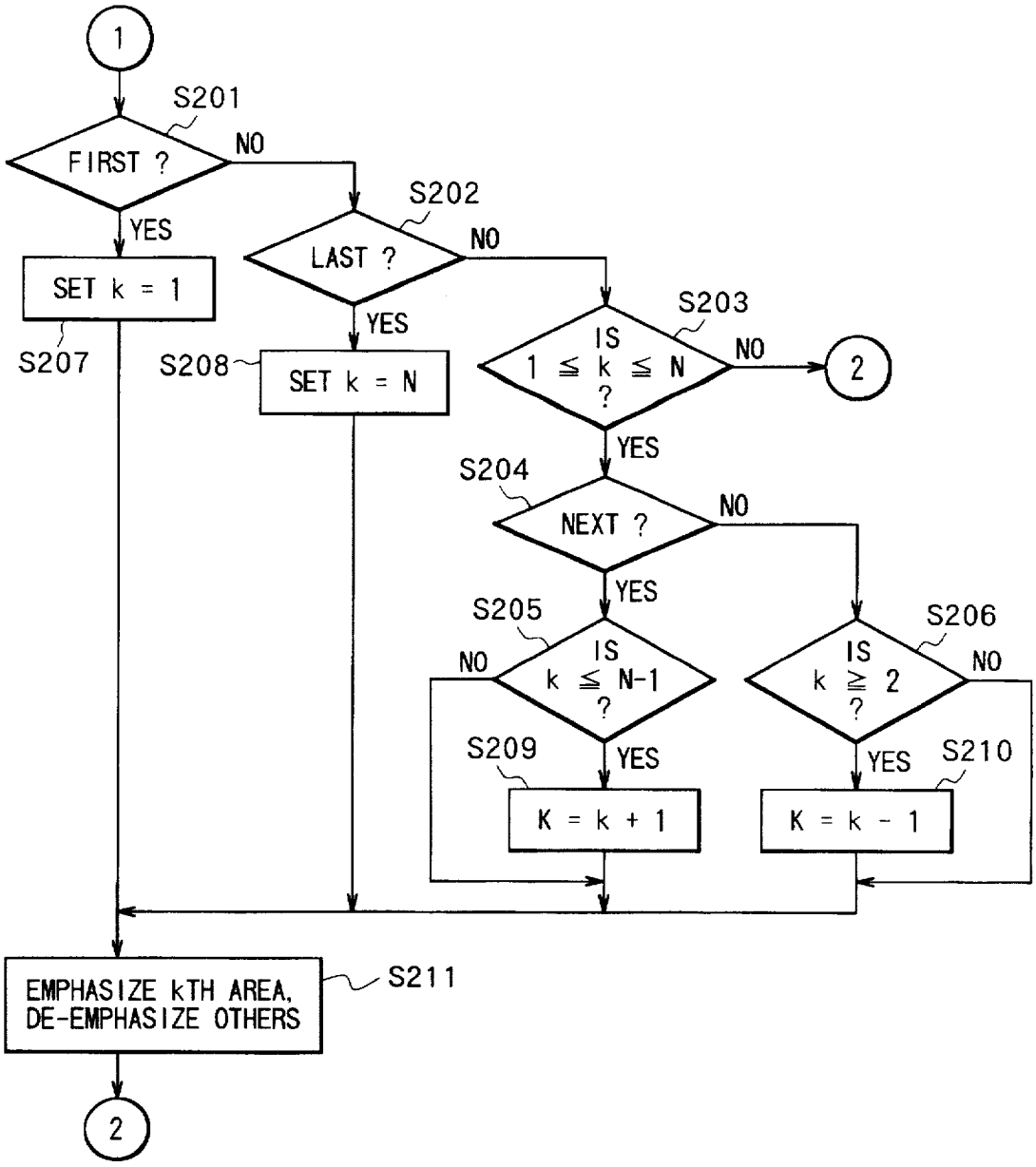
FIG. 8 is a flowchart showing a second part of a sewing order verification process executed as an interrupt in the process of FIG. 6.

If "Verify Sewing Order" is selected when the input/edit screen G is being displayed, the CPU 11 executes the interrupt procedure shown in FIGS. 7 and 8 for verifying the sewing order. First, the CPU 11 determines whether at least one sewing area has been selected for verification of sewing order (S101). Sewing areas can be selected by, for example, clicking the mouse 18 on an area displayed in the image area g1 of FIG. 3(*a*). In this embodiment, the four outlines for areas R2, R4, R5, and R7 are selected to verify their sewing order in relation to one another. FIG. 4 shows the status of the input/edit screen G after these selections have been made. According to FIG. 4, lines are added to the selected sewing areas.

If no sewing areas have been selected for verification of the sewing order (S101: No), all the sewing areas are stored as the targets of this verification (S103). However, if selections have been made (S101: Yes), only the selected areas are stored for verification (S102). As shown in FIG. 5, in the step S102, the sewing order storage table T2 is constructed within a verification target storage area B, which has been allocated in a specific portion of the RAM 13. The selected embroidery areas are written to this table T2 beginning from the top of the table according to the sewing order. In this embodiment, it will be assumed that the embroidery areas R2, R4, R5, and R7 selected earlier, as shown in FIG. 4, are successively written according to the sewing order.

Next, the total number N of sewing areas targeted for verification is set (S104). In this example, therefore, the total number N is set to 4. Then, the routine proceeds to S105 in which as shown in FIG. 3(*b*) a dialog box specifying order data is displayed in the input/edit screen G, allowing the user to verify the sewing order. In this dialog box, any of the selections "First", "Next", "Previous", and "Last" are specified. In addition, the user can select "End Verification" to end the process of verifying the sewing order.

Next, all the embroidery areas R1–R7 are displayed without emphasis in the input/edit screen G (S106). That is, the outline of each embroidery area is depicted with a dotted line (not shown). This change in display allows the user to differentiate between the normal display mode and the verification of sewing order display mode.

Next, in step S107, the sewing order management counter k used for the verification display is initialized to 0. The user selects one of the options "First" "Last" or "End Verification" in the dialog box already displayed in the step S105. In this selection, the two items "Next" and "Previous" cannot be selected under the condition that the counter k is set at 0.

Then, the operator selects one of the selections "First", "Last", and "End Verification" displayed in the dialog box, and the specified selection is stored in the memory in step S108. Then, the CPU 11 determines whether or not the selection is "End Verification" (S109). If "End Verification" has been selected (S109: Yes), the dialog box is removed from the display (S110), and all the embroidery areas R1–R7 are displayed normally with solid lines on the input/edit screen G (S111). By changing the displayed style of the embroidery areas back to solid lines, the user can determine that the verification mode has ended. At this point, the CPU 11 returns to the process in FIG. 6.

Figure 9:
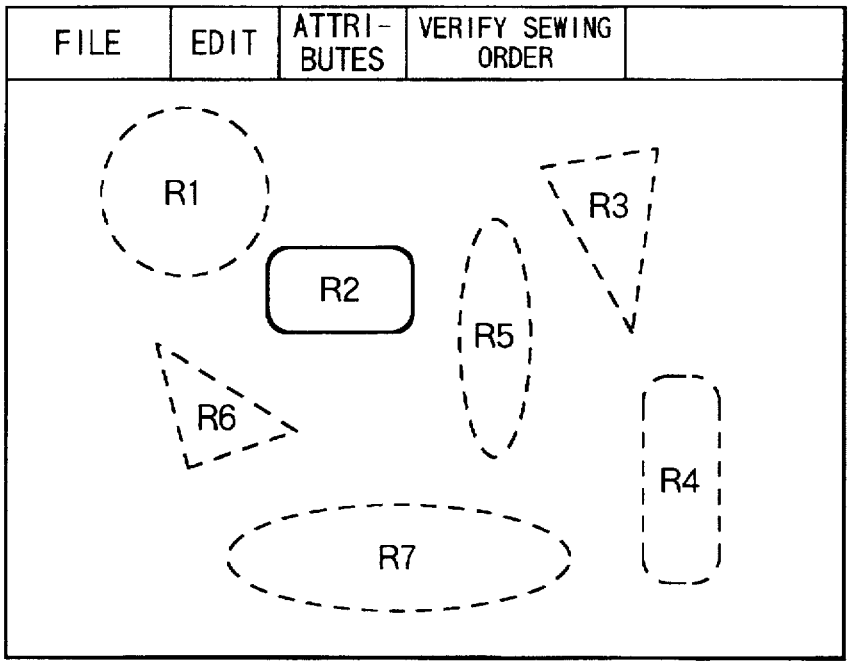
FIG. 9(*a*) shows a display which highlights a first sewing area among the selected sewing areas in FIG. 4.
Figure 9:
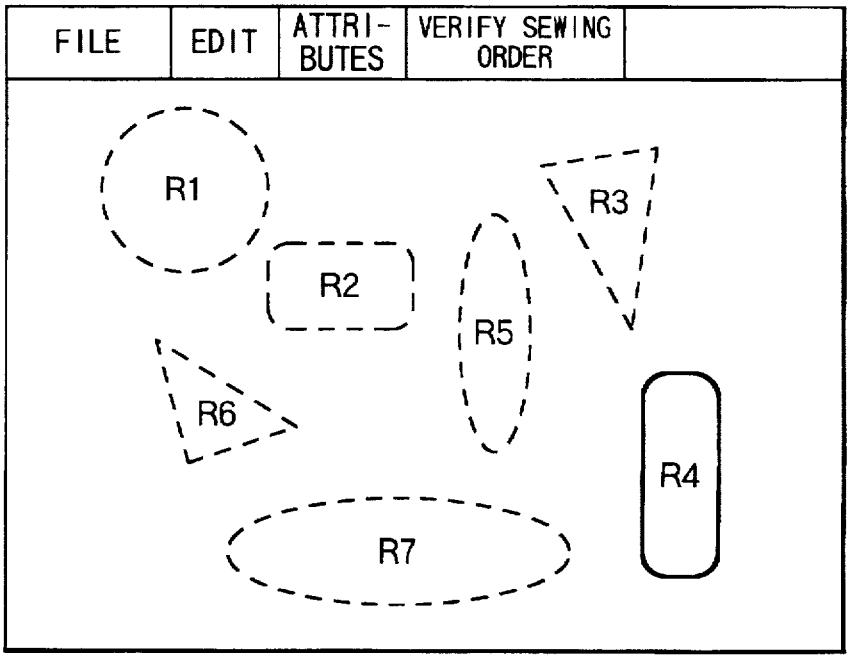

If "End Verification" has not been selected (S109: No), then the CPU 11 executes a process shown in FIG. 8. First, the CPU 11 determines if the selection is "First" (S201). If the selection is "First", the counter k is set to the value 1 (S207). Then the routine proceeds to step S211 where the outline of the first embroidery area in the order of areas extracted as verification targets is displayed in bold, while the remaining embroidery areas are de-emphasized. In this example, therefore, the outline of R2, which is the first in the order R2, R4, R5, and R7, is emphasized. The status of the display at this time is shown in FIG. 9(*a*). The outline of embroidery area R2 is displayed bolder than during normal display, while the outlines of the other areas are depicted with dotted lines. While the screen shown in FIG. 9(*a*) is displayed, the dialog box is also still displayed, allowing the user to make further selections. If the user makes further selections in the dialog box, the routine returns the step S108 of FIG. 7.

If in the step S201 "First" has not been selected (S201: No), then the CPU 11 determines whether "Last" has been selected (S202). If the selection is "Last" (S202: Yes) the counter k is set to the total number N (that is N=4) set in S104 (S208). Then, the outline of the last embroidery area is displayed in bold, while the remaining embroidery areas are de-emphasized (S211). Therefore, the outline of R7, which is last in the order R2, R4, R5, and R7, is emphasized. The status of the display at this time is shown in FIG. 10(b).

If in step S202 "Last" has not been selected (S202: No), then the CPU 11 determines whether the value k is between 1 and N (S203). If the value k is still set to its initial value of 0, that is, if the operator has not yet selected one of the items in the dialog box, the determination in the step S203 falls No. Then, the CPU 11 waits for the user to select one of the items "First," "Last," or "End Verification" in the dialog box. Once the user makes a selection, the process continues from the step S108.

If step S203 is reached after passing through either step S207 or S208, the counter k has been set to a value between 1 and N (S203: Yes). In this case, the CPU 11 determines whether "Next" has been selected (S204). If the selection is "Next" (S204: Yes), the CPU 11 checks whether the counter k is less than or equal to N−1 (S205). If the counter k is less than or equal to N−1 (S205: Yes), then the counter k is incremented one (S209). If the counter k is greater than N−1, then the counter k is not incremented. In either case, the process moves to step S211.

For example, if "Next" is selected while "R4" is highlighted (k=2), the result of the determination in the step S205 is Yes. Then the k is incremented to "3" S209. Therefore, "R5" is highlighted in the step S211. On the other hand, if "Next" is selected while "R7" is highlighted (k=4), the determination in the step S205 falls No, so that "R7" is still highlighted in the step S211.

FIG. 9(*b*) shows the input/edit screen G after "First" was selected from the dialog box followed by "Next." At this time, the outline of the second embroidery area is displayed in bold, while the remaining embroidery areas are de-emphasized (S211). Therefore, the outline of R4, which is second in the order R2, R4, R5, and R7, is emphasized.

If in step S204 "Next" has not been selected (S204: No), indicating that "Previous" has been selected, the CPU 11 determines whether the counter k is greater than or equal to 2 (S206). If the counter k is greater than or equal to 2 (S206: Yes), then the counter k is decremented one (S210). If the counter k is less than 2, then the counter k is not decremented. In either case, the process moves to step S211.

For example, if "Previous" is selected while R5 is highlighted (k=3), the determination in the step S206 falls Yes, so that the k is decremented to 2. Therefore, R4 is highlighted in the step S211. On the other hand, if "Previous" is selected while R2 is highlighted (k=1), the determination in the step S206 falls No, so that R2 is still highlighted in the step S211.

Figure 10:
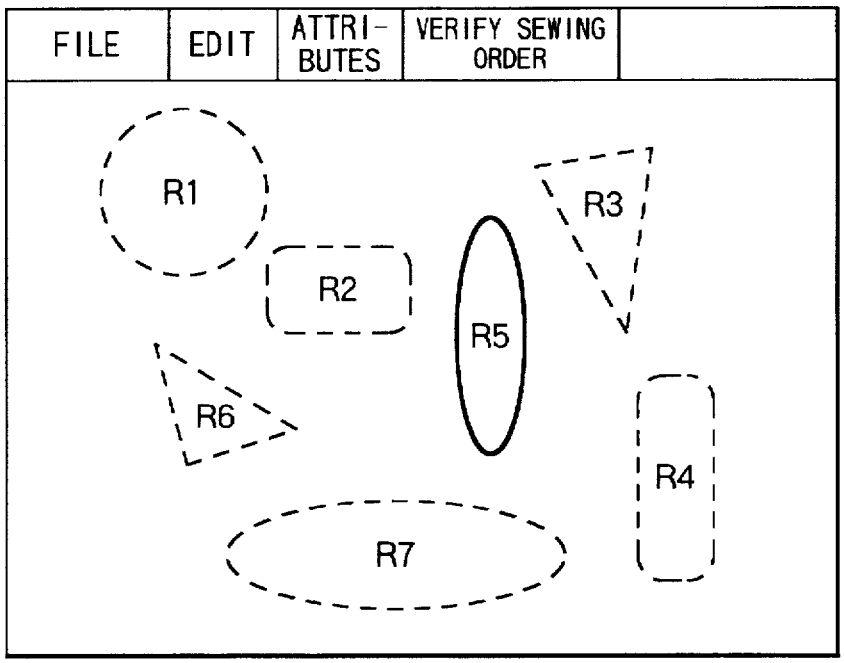
FIG. 10(*a*) shows a display which highlights a second to last sewing area among the selected sewing areas.
Figure 10:
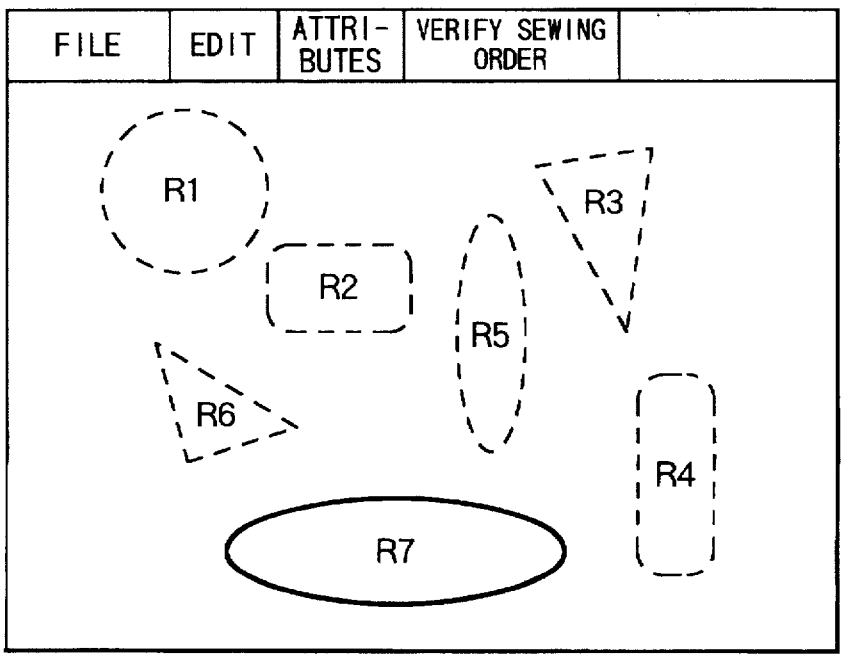

FIG. 10(*a*) shows the input/edit screen G after "Last" was selected from the dialog box followed by "Previous." At this time, the outline of the next to last embroidery area is displayed in bold, while the remaining embroidery areas are de-emphasized (S211). Therefore, the outline of R5, which is second to last in the order R2, R4, R5, and R7, is emphasized. The user can select "End Verification" in the dialog box when he or she is finished verifying the sewing order.

In view of the foregoing, in the embroidery data processing unit, only the extracted sewing areas can be subjected to verification of the sewing order. Hence, the sewing order of specific sewing areas can be verified in a short time. In this case, the extraction can be easily performed by using the memory area B and manipulating the mouse 18. Further by using the dialog box, the operator can easily learn the sewing order between the two sewing areas.

While the invention has been described in detail and with reference to the specific embodiments thereof, it would be apparent to those skilled in the art that various changes and modifications may be made therein without departing from the spirit and scope of the invention. For example, in the embodiment described above, the embroidery data processing unit is configured so the user can specify order data in the dialog box, but the present invention also applies to order data being automatically set under specific conditions.

Further, in the depicted embodiment, the embroidery area corresponding to the value of the counter k is emphasized in bold, while the other areas are de-emphasized. However, it is obvious that other methods can be applied to differentiate between the area corresponding to counter k and the other areas.

Further, in the depicted embodiment, the configuration of the embroidery data processing unit 1 is the same as that of a personal computer. However, the data processing unit could instead be configured with special hardware for embroidery data processing. For example, the embroidery sewing machine 2 could be provided with a special internal embroidery data processing unit.

Further, in the depicted embodiment, the functions "File", "Edit", "Attributes", and "Verify Sewing Order" are displayed. However, the present invention is not limited to these functions.

Further, in the sewing area selection step S101, the outlines of the embroidery areas R1–R7 and the areas enclosed within those outlines can be selected as separate sewing areas. That is, the outline and an area defined within the outline are treated as separate sewing areas.

Further, in the present invention, sewing order of from at least two sewing areas to a total number minus one sewing areas can be selected as the targets for verifying the sewing order by employing the verification target storage area B. That is only the intended sewing areas can be subjected to the sewing order verification. If sewing order of all sewing areas are to be verified, the data may be retrieved from the sewing order storage area A only, and the verification target storage area B is dispensed with. However, such is not the heart of the present Invention.

What is claimed is:

1. An embroidery data processing unit comprising:

means for creating a sewing pattern having a plurality of sewing areas;

memory means for storing a sewing order with respect to the plurality of sewing areas;

extracting means for extracting at least two sewing areas from among the plurality of sewing areas as targets for verification of sewing order;

distinguishing means for distinguishing the sewing order of the at least two sewing areas extracted by the extracting means; and display means for displaying the sewing areas according to a distinguishing result in the distinguishing means and for displaying the sewing pattern created by the creating means.

2. The embroidery data processing unit as claimed in claim 1, further comprising data input means controlled by a user for inputting an order selection command with respect to the at least two sewing areas extracted by the extracting means.

3. The embroidery data processing unit as claimed in claim 2, wherein the display means displays the at least two sewing areas based on order selection commands input by the data input means and on results of the distinguishing means.

4. The embroidery data processing unit as claimed in claim 1, wherein the sewing pattern created by the creating means comprises one kind of sewing pattern, and wherein the plurality of sewing areas comprise a plurality of parts of the one kind of sewing pattern, a combination of the parts providing the one kind of sewing pattern.

5. The embroidery data processing unit as claimed in claim 1, wherein the plurality of sewing areas created by the creating means comprise different kinds of sewing patterns independent of one another.

6. The embroidery data processing unit as claimed in claim 1, wherein the extracting means extracts from the at least two sewing areas to a total number minus one sewing areas.

7. An embroidery data processing unit for acknowledging sewing order with respect to a plurality of sewing areas, a combination of the plurality of sewing areas providing one kind of a sewing pattern, the unit comprising;

memory means for storing a sewing order with respect to the plurality of sewing areas;

extracting means for extracting at least two sewing areas from among the plurality of sewing areas as targets for verification of sewing order;

distinguishing means for distinguishing the sewing order of the at least two sewing areas extracted by the extracting means; and display means for displaying the at least two sewing areas according to a distinguishing result in the distinguishing means.

8. The embroidery data processing unit as claimed in claim 7, further comprising data input means controlled by a user for inputting an order selection command with respect to the at least two sewing areas extracted by the extracting means.

9. The embroidery data processing unit as claimed in claim 8, wherein the display means displays the at least two sewing areas based on order selection commands input by the data input means and on results of the distinguishing means.

10. The embroidery data processing unit as claimed in claim 7, further comprising means for creating the one kind of sewing pattern having the plurality of sewing areas, the display means also displaying the one kind of sewing pattern created by the creating means.

11. The embroidery data processing unit as claimed in claim 7, wherein the extracting means extracts from the at least two sewing areas to a total number minus one sewing areas.

12. An embroidery data processing unit for acknowledging sewing order with respect to a plurality of sewing areas, the plurality of sewing areas being different kinds of sewing patterns independent of each other, the unit comprising:

memory means for storing a sewing order with respect to the plurality of sewing areas;

extracting means for extracting at least two sewing areas from among the plurality of sewing areas as targets for verification of sewing order;

distinguishing means for distinguishing the sewing order of the at least two sewing areas extracted by the extracting means; and display means for displaying the at least two sewing areas according to a distinguishing result in the distinguishing means.

13. The embroidery data processing unit as claimed in claim 12, further comprising data input means controlled by a user for inputting an order selection command with respect to the at least two sewing areas extracted by the extracting means.

14. The embroidery data processing unit as claimed in claim 13, wherein the display means displays the at least two sewing areas based on order selection commands input by the data input means and on results of the distinguishing means.

15. The embroidery data processing unit as claimed in claim 12, further comprising means for creating the different kinds of sewing patterns, the display means also displaying the different kinds of sewing patterns created by the creating means.

16. The embroidery data processing unit as claimed in claim 12, wherein the extracting means extracts from the at least two sewing areas to a total number minus one sewing areas.

17. An embroidery data processing unit for acknowledging sewing order with respect to an N number plurality of sewing areas, the unit comprising:

memory means for storing a sewing order with respect to the plurality of sewing areas;

extracting means for extracting at least two sewing areas, up to (N−1) sewing areas, from among the plurality of sewing areas as targets for verification of sewing order;

distinguishing means for distinguishing the sewing order of the at least two sewing areas extracted by the extracting means; and display means for displaying the at least two sewing areas according to a distinguishing result in the distinguishing means.

18. The embroidery data processing unit as claimed in claim 17, further comprising data input means controlled by a user for inputting an order selection command with respect to the at least two sewing areas extracted by the extracting means.

19. The embroidery data processing unit as claimed in claim 18, wherein the display means displays the at least two sewing areas based on order selection commands input by the data input means and on results of the distinguishing means.

20. The embroidery data processing unit as claimed in claim 17, further comprising means for creating a sewing pattern having the plurality of sewing areas, the display means also displaying the sewing pattern created by the creating means.

21. The embroidery data processing unit as claimed in claim 20, wherein the sewing pattern created by the creating means comprises one kind of sewing pattern, and wherein the plurality of sewing areas comprise a plurality of parts of the one kind of sewing pattern, a combination of the parts providing the one kind sewing pattern.

22. The embroidery data processing unit as claimed in claim 20, wherein the plurality of sewing areas created by the creating means comprise different kinds of sewing patterns independent of one another.

* * * * *